US009484177B2

(12) United States Patent
Ausburn

(10) Patent No.: US 9,484,177 B2
(45) Date of Patent: Nov. 1, 2016

(54) LONGITUDINAL HIGH DOSE OUTPUT, THROUGH TRANSMISSION TARGET X-RAY SYSTEM AND METHODS OF USE

(71) Applicant: Rad Source Technologies, Inc., Suwanee, GA (US)

(72) Inventor: Phillip Kent Ausburn, Cumming, GA (US)

(73) Assignee: Rad Source Technologies, Inc., Suwanee, GA (US)

( * ) Notice: Subject to any disclaimer, the term of this patent is extended or adjusted under 35 U.S.C. 154(b) by 21 days.

(21) Appl. No.: 14/685,795

(22) Filed: Apr. 14, 2015

(65) Prior Publication Data

US 2016/0189907 A1 Jun. 30, 2016

Related U.S. Application Data

(63) Continuation-in-part of application No. 14/587,634, filed on Dec. 31, 2014.

(51) Int. Cl.
*H01J 35/08* (2006.01)
*H01J 35/06* (2006.01)

(52) U.S. Cl.
CPC ..... *H01J 35/08* (2013.01); *H01J 35/06* (2013.01); *H01J 2235/087* (2013.01)

(58) Field of Classification Search
USPC ..... 378/134, 92, 101, 140, 143
See application file for complete search history.

(56) References Cited

U.S. PATENT DOCUMENTS

2015/0078532 A1* 3/2015 Tang ..... H01J 35/14 378/134

* cited by examiner

*Primary Examiner* — Kiet T Nguyen
(74) *Attorney, Agent, or Firm* — Mathew L. Grell; Grell & Watson Patent Attorneys

(57) ABSTRACT

An X-ray tube for accelerating electrons under a high voltage potential, said X-ray tube includes an evacuated elongated housing that is sealed, a through transmission target anode deposited on an inner surface of said elongated housing, said through transmission target anode configured having a cross-sectional center, a cathode structure disposed in said elongated housing, said cathode structure configured to emit the electrons toward said through transmission target anode, two or more filaments disposed linearly in said elongated housing, said two or more filaments linearly positioned end-to-end proximate said cross-sectional center, said evacuated housing configured to vacuum seal therein said two or more filaments, and, thus, such X-ray tube functions to provide a lengthened, elongated, symmetrical radiation field.

23 Claims, 10 Drawing Sheets

LONGITUDINAL HIGH DOSE OUTPUT, THROUGH TRANSMISSION TARGET X-RAY SYSTEM AND METHODS OF USE

CROSS REFERENCE TO RELATED APPLICATIONS

To the full extent permitted by law, the present United States Non-Provisional patent application claims priority to and the full benefit of United States Non-Provisional patent application entitled "High dose output, through transmission target X-ray system and methods of use", filed on Dec. 31, 2014, having assigned Ser. No. 14/587,634, incorporated entirely herein by reference.

TECHNICAL FIELD

The disclosure relates generally to X-ray tube technology and more specifically it relates to X-ray tubes with specific anode, cathode, filament configurations and material choices to produce high dose X-ray output.

BACKGROUND

In many typical state of the art X-ray tubes, a cathode assembly and an anode assembly are vacuum sealed in a glass or metal envelope. Electrons are generated by a cathode filament in the cathode assembly. These electrons are accelerated toward the anode assembly by a high voltage electrical field. The high energy electrons generate X-rays upon impact with the anode assembly. A by-product of this process is the generation of substantial amounts of heat.

Traditional X-ray tube configurations are known in the prior art, for example, Coolidge type X-ray tubes. In a Coolidge tube X-ray photons, shown as a spot output radiation pattern, are generated by impinging an electron beam emanating from filament onto the surface of a target anode. Coolidge tubes may be operated single ended with the cathode at a negative potential and the anode at ground, or double ended with the cathode at a negative potential and the anode at a positive potential. In either configuration the energy of acceleration is the difference between the electrode potentials. In a Coolidge X-ray tube the target anode is fabricated from a heavy metal such as tungsten, tantalum or iridium and such materials are selected because of their density and high melting point. The material of the target anode is most often mounted onto a thermally conductive material such as copper and is externally cooled either by water or dielectric oil.

The target anode is placed in line with the electron beam and radiation is emitted at right angles to the electron beam. The spectrum of the output radiation is predominantly bremsstrahlung and is altered by changing the accelerating energy of the electron beam. Tubes of this nature are in use in industrial imaging, medical imaging, analytical and irradiation application. The primary limitation of this type of tube is the watt density loading of the target anode before melting occurs, limited utilization of generated X-ray photons and the symmetry of the resulting radiation field. Because the resolution of an imaging device, either electronic or film, is a function of the size of the electron beam projected onto the target anode. For optimal image resolution a small focal spot is desired, but for optimal image contrast a large number of X-ray photons are desired. The two requirements are contrary and cannot be resolved in the traditional tube design. In addition the reflective nature of the emitted radiation is asymmetrical about a beam centerline and is grossly inefficient for X-ray irradiation applications.

Recently, some low power through transmission elongated X-ray tubes has become available on the market. These tubes utilize a single filament and the filament does not heat uniformly rather the filament tends to heat up in the center generating most electrons in the center of the filament, and thus causing a short or narrow linear Gaussian radiation output pattern.

Therefore, it is readily apparent that there is a recognizable unmet need for a longitudinal high dose output, through transmission target X-ray system and methods of use, having a large surface area anode target to dissipate heat, and thus, enabling multiple shortened cathode filaments, higher atomic number target material with improved radiation output, lower melting point and higher vaporization pressure, and lower electrode potential required to produce higher output radiation.

BRIEF SUMMARY

Briefly described, in example embodiment, the present apparatus overcomes the above-mentioned disadvantage, and meets the recognized need for a longitudinal high dose output, through transmission target X-ray tube and methods of use including, in general, an X-ray tube for accelerating electrons under a high voltage potential, said X-ray tube includes an evacuated elongated housing that is sealed, a through transmission target anode deposited on an inner surface of said elongated housing, said through transmission target anode configured having a cross-sectional center, a cathode structure disposed in said elongated housing, said cathode structure configured to emit the electrons toward said through transmission target anode, two or more filaments disposed linearly in said elongated housing, said two or more filaments linearly positioned end-to-end proximate said cross-sectional center, said evacuated housing configured to vacuum seal therein said two or more filaments, and, thus, such X-ray tube functions to enable multiple shortened cathode filaments, higher atomic number target material with improved radiation output, lower melting point and higher vaporization pressure, and lower electrode potential required to produce a lengthened, elongated, symmetrical radiation field with higher output radiation.

According to its major aspects and broadly stated, the a longitudinal high dose output, through transmission target X-ray tube and methods of use includes, in general, an X-ray tube for accelerating electrons under a high voltage potential, said X-ray tube includes an evacuated elongated housing that is sealed, a through transmission target anode deposited on an inner surface of said elongated housing, said through transmission target anode configured having a cross-sectional center (axis), a cathode structure disposed in said elongated housing, said cathode structure configured to emit the electrons toward said through transmission target anode, two or more filaments disposed linearly in said elongated housing, said two or more filaments linearly positioned end-to-end (mechanically in series) proximate said cross-sectional center, said evacuated housing configured to vacuum seal therein said two or more filaments.

In an exemplary embodiment of longitudinal through transmission target X-ray tube and methods of use, includes an elongated housing that is evacuated, a through transmission target anode structure disposed on the elongated housing, the anode structure configured having a geometric center, a cathode structure disposed on a first end of the housing, the cathode structure configured to deflect the electrons toward the anode structure, two or more filaments disposed in the elongated housing, the two or more filaments positioned proximate the geometric center of the elongated housing and positioned mechanically in series, wherein the elongated housing is configured to vacuum seal therein the anode structure, the cathode structure, and the two or more filaments.

In another exemplary embodiment a method to produce a lengthened x-ray field, the method includes the steps of providing an X-ray tube for accelerating electrons under a high voltage potential, the X-ray tube comprising, an elongated housing that is evacuated, a through transmission target anode structure disposed on the elongated housing, the anode structure configured having a geometric center, a cathode structure disposed on a first end of the housing, the cathode structure configured to deflect the electrons toward the anode structure, two or more filaments disposed in the elongated housing, the two or more filaments positioned proximate the geometric center of the elongated housing and positioned mechanically in series, wherein the elongated housing is configured to vacuum seal therein the anode structure, the cathode structure, and the two or more filaments, selecting an accelerating voltage for an adjustable high voltage power supply electrically connected between the anode structure and the cathode, and selecting a filament voltages for one or more adjustable filament power supply electrically connected to the two or more filaments.

Accordingly, a feature of the longitudinal high dose output, through transmission target X-ray tube and methods of use is its ability to equalize the output radiation pattern and power density in cylindrical shaped transmission anode X-ray tubes by using two or more active filaments. The two or more filaments are mounted mechanically in series and coincident with the axis of the cylindrical anode.

Accordingly, a feature of the longitudinal high dose output, through transmission target X-ray tube and methods of use is its ability to generate a longer more symmetrical radiation field.

Another feature of the longitudinal high dose output, through transmission target X-ray tube and methods of use is its ability to provide a large surface area through transmission anode target to dissipate heat.

Still another feature of the longitudinal high dose output, through transmission target X-ray tube and methods of use is its ability to use target materials with lower melting points for specialized applications such as the generation of monochromatic X-rays and for therapeutic applications. Yet another feature the longitudinal high dose output, through transmission target X-ray tube and methods of use is its ability to provide X-ray tube that requires no or limited heat dissipation in the form of air cooling or liquid cooling. Moreover, forced air cooling is thus more effective because of the increased surface area of the new anode configuration.

Yet another feature the longitudinal high dose output, through transmission target X-ray tube and methods of use is its ability to provide an X-ray tube with increased longevity due to the large surface area anode target ability to dissipate heat.

Yet another feature of the longitudinal high dose output, through transmission target X-ray tube and methods of use is its ability to provide a new structure and geometry for the anode to increase the surface area of the anode.

Yet another feature of the longitudinal high dose output, through transmission target X-ray tube and methods of use is its ability to provide an anode configuration with better heat transfer characteristics which would enable the anode to operate at a lower temperature, and thus enable a lower melting point material choice with improved radiation output and extend the operational life of the X-ray tube.

Yet another feature of the longitudinal high dose output, through transmission target X-ray tube and methods of use is its ability to provide a new structure and geometry for the cathode structure which deflects and/or accelerates the electrons toward the through transmission anode.

Yet another feature of the longitudinal high dose output, through transmission target X-ray tube and methods of use is its ability to provide a new structure and geometry for the two or more filaments which releases the electrons evenly distributed toward the cylindrical or elongated housing or through transmission anode to generate a lengthened symmetrical radiation field.

Yet another feature of the longitudinal high dose output, through transmission target X-ray tube and methods of use is its ability to provide minimal anode target to radiation sample distance resulting in an X-ray source which can be placed closer to a subject or object.

Yet another feature of the longitudinal high dose output, through transmission target X-ray tube and methods of use is its ability to produces X-rays used for bulk biological or organic material radiation, such as conveyorized radiation system, pest control via pupa sterilization radiation treatment, treating certain diseases by killing or altering human cells, imaging, such as medical, industrial, and dual energy, non-destructive evaluation of objects, X-ray defection, X-ray diffraction patterns, therapeutic X-ray, analytical X-ray, and X-ray microscopy.

Yet another feature of the longitudinal high dose output, through transmission target X-ray tube and methods of use is its ability to produces X-rays used for mass sterilization systems, such as for tissue and bone bank sterilization to irradiate whole lots of frozen specimens in a short duration.

Yet another feature of the longitudinal high dose output, through transmission target X-ray tube and methods of use is its ability to produces X-rays used for food sterilization systems, such as for example irradiation of batches of herbs, spices, oysters, nutraceuticals and the like in a short duration.

These and other features of longitudinal high dose output, through transmission target X-ray tube and methods of use will become more apparent to one skilled in the art from the following Detailed Description of the exemplary Embodiments and Claims when read in light of the accompanying drawing Figures.

BRIEF DESCRIPTION OF THE DRAWINGS

The present longitudinal high dose output, through transmission target X-ray tube and methods of use will be better understood by reading the Detailed Description of the exemplary embodiments with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-9 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
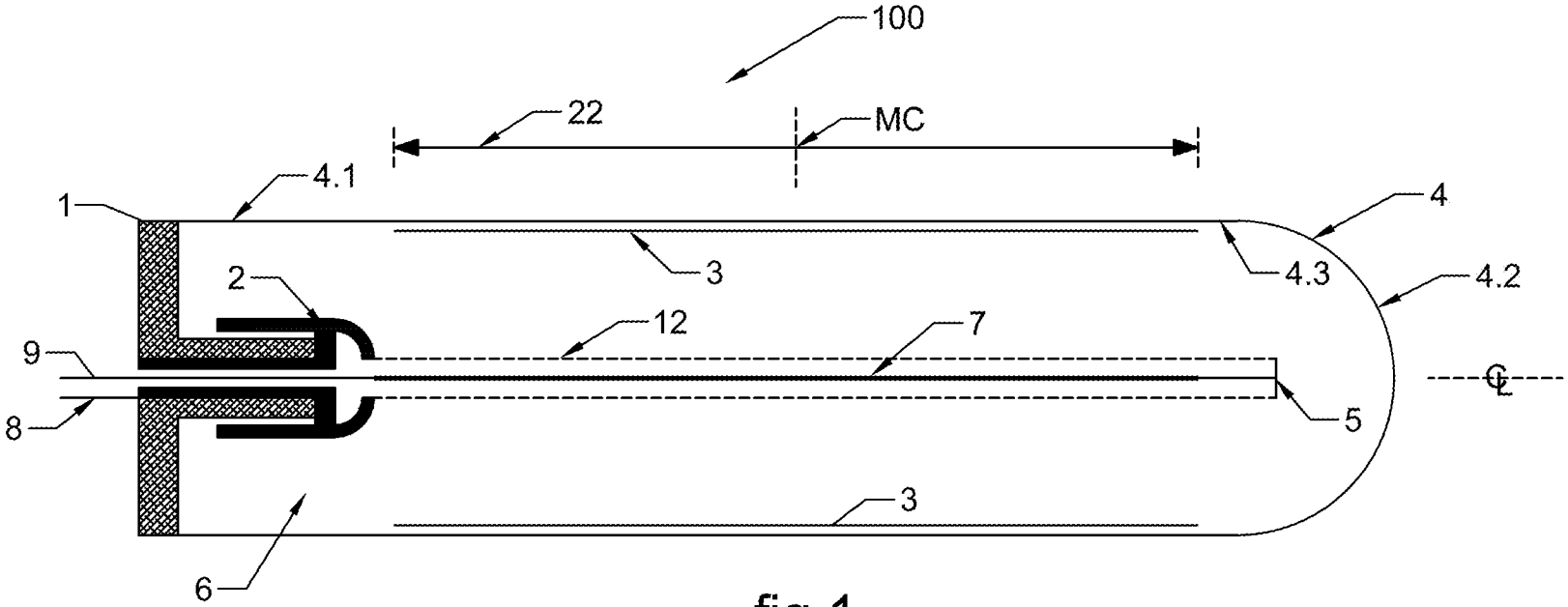
FIG. 1 is a cross sectional side view of a cylindrical anode X-ray tube with a single filament.

Referring now to FIG. 1 there is illustrated a cross sectional side view of a cylindrical anode X-ray tube 100 which includes evacuated sealed chamber or envelope, such as tubular housing 4, which may be glass, alloy or metal, high voltage insulator 1 positioned on one end or first end 4.1 of tubular housing 4, vacuum dielectric 6, approximately $1\times10^{-10}$ mBar, contained therein tubular X-ray housing 4.

Contained within anode structure, tubular housing 4 are elements, such as, cathode structure 2, first filament lead 8, second filament leads 9, and single filament 7. Cathode structure 2 may be connected to ground, cathode electrical connection, or first filament lead 8 of adjustable high voltage power supply shown in FIG. 3. One end or first filament end of single filament 7 is electrically connected to first cathode electrical connection or filament lead 8 and first filament lead 8 may also be electrically connected to filament adjustable power supply shown in FIG. 3 and the other end or second filament end of single filament 7 may be electrical connected to filament electrical connection or second filament lead 9 and second filament lead 9 may also be electrically connected to filament adjustable power supply shown in FIG. 3.

Moreover, tubular housing 4 includes target, target element, or target material, or an increased anode target surface area, such as anode target or through transmission anode 3 deposited, formed or configured thereon tubular housing 4 as through transmission target anode structure, where through transmission anode 3 is preferably deposited thereon inner surface 4.3 of tubular housing 4. Preferably target 3 being the electron interacting material deposited thereon inner surface 4.3 of tubular housing 4 and together comprise anode structure.

Figure 2:
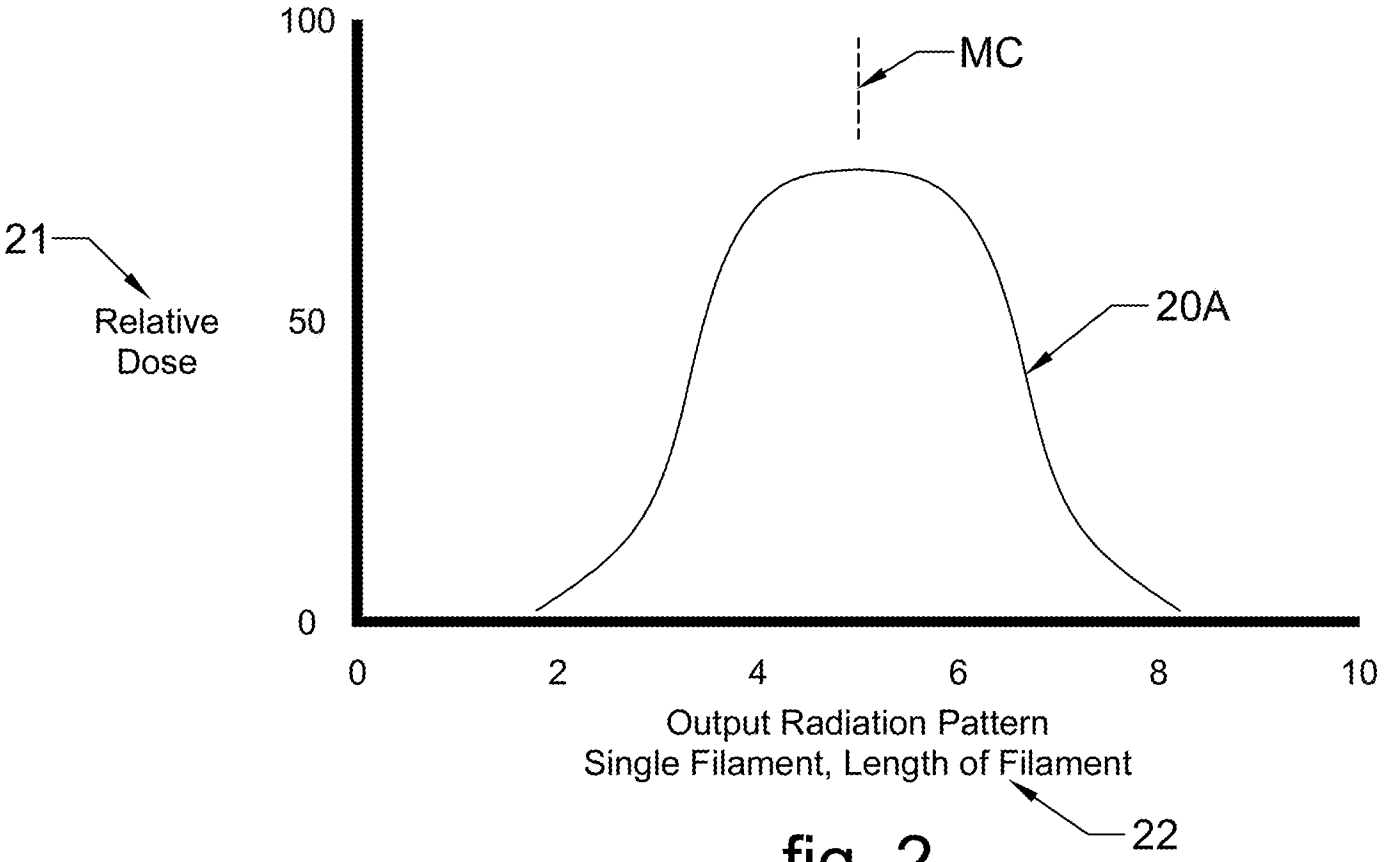
FIG. 2 is a graphical representation of the single filament cylindrical anode X-ray tube of FIG. 1 showing relative DOSE verses filament length.

Moreover, inner surface 4.3 of tubular housing 4 may be coated with various elements, combination of elements or their alloys as through transmission anode 3 to form anode structure and produce desirable characteristic symmetrical shaped x-ray field, such as radiation 30A (output x-ray spectrum) shown in FIG. 2. High Z elements may be selected to produce increased output with Gaussian like output radiation pattern.

Referring now to FIG. 2 there is illustrated a graphical representation of relative output radiation DOSE verses length 22 of single filament 7 of cylindrical anode X-ray tube 100. Relative output radiation DOSE 21 is a consequence of the shape of the electron space charge region along length 22 of single filament 7. All filaments in X-ray tubes or light bulbs tend to heat from the center outwards. This phenomena causes a Gaussian like space charge region shape along length 22 of single filament 7 coincident with a center line or mechanical center MC of single filament 7 and is responsible for the output radiation pattern and thermal signature of the anode peaking near center line or mechanical center MC of single filament 7, and thus, generating most electrons in the center of single filament 7, and causing a narrow linear radiation output pattern. Moreover, relative output radiation DOSE 21 is from two (2) to eight (8) on length 22 of single filament 7, and more specifically narrowly peaking in relative output radiation DOSE 21 from four (4) to six (6) on length 22 of single filament 7.

Figure 3:
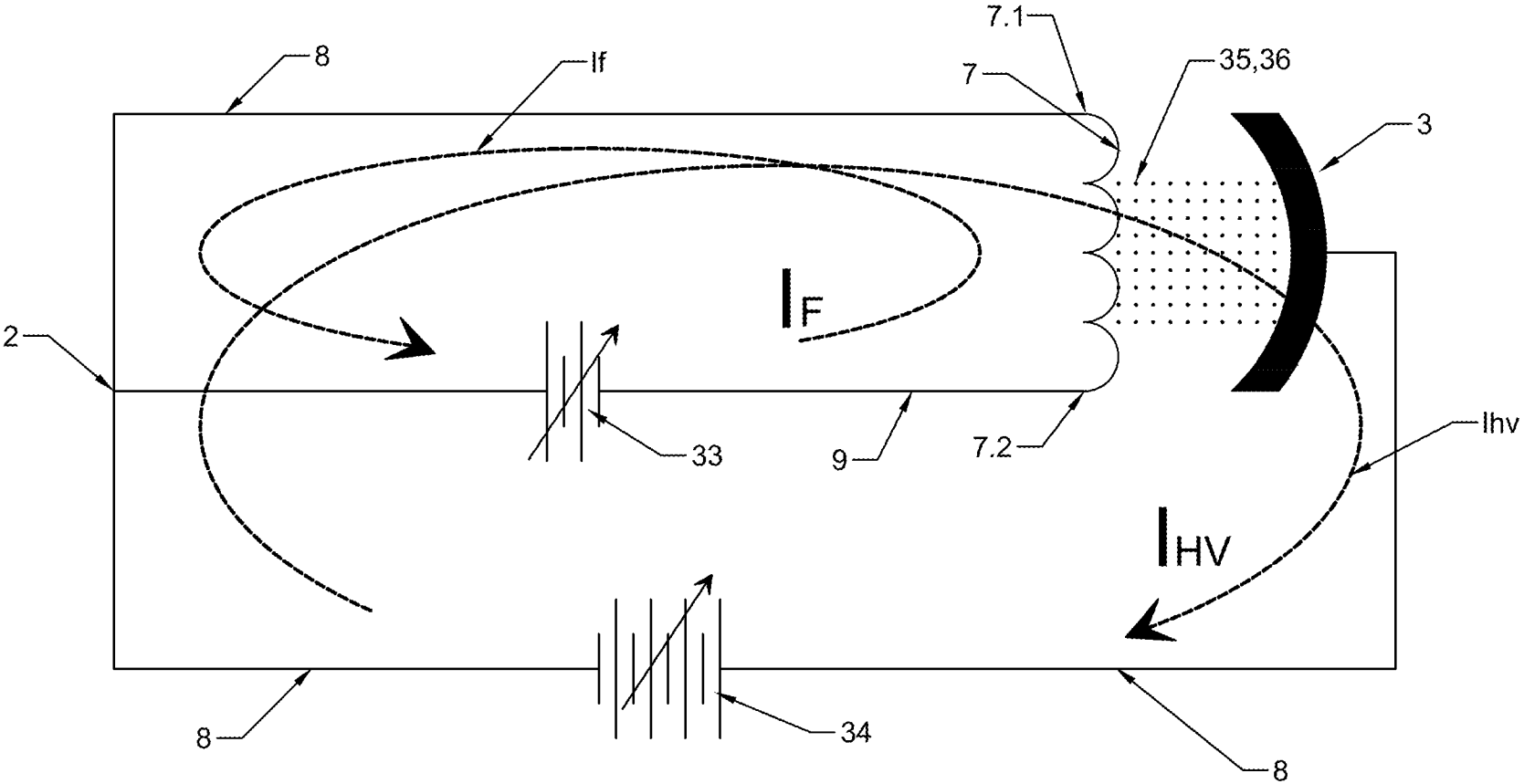
FIG. 3 is a schematic representation of the single filament cylindrical anode X-ray tube of FIG. 1 showing a profile of the electron trajectory lines which are being emitted from the filament.

Referring now to FIG. 3 there is illustrated a schematic representation of the single filament, cylindrical anode X-ray tube 100 showing a profile of the electron 5 trajectory lines which are being emitted from single filament 7. One end or first filament end 7.1 of single filament 7 is electrically connected to first cathode electrical connection or filament lead 9 and first filament lead 9 may also be electrically connected to adjustable filament power supply 33 and the other end or second filament end 7.2 of single filament 7 may be electrical connected to filament electrical connection or second filament lead 9 and second filament lead 9 may also be electrically connected to adjustable filament power supply 33. In an X-ray system, adjustable filament power supply 33 is referenced to cathode potential and provides current $I_F$ necessary to heat single filament 7, and thus, create a symmetrical electron distribution, such as space charge region shown as trajectory 36 of electrons 35 along length 22 of single filament 7. The difference in potential between cathode structure 2 and cylindrical through transmission anode 3 caused by adjustable high voltage power supply 34 extracts electrons from the space charge region shown as trajectory 36 of electrons 35 along length 22 of single filament 7 and accelerates electrons towards through transmission anode 3. The number of electrons that are accelerated constitutes high voltage current $I_{HV}$ and is determined by the temperature of single filament 7 and the high voltage potential of adjustable high voltage power supply 34. In practical X-ray systems single filament 7 current/filament temperature are determined by the desired high voltage current $I_{HV}$.

Figure 4:
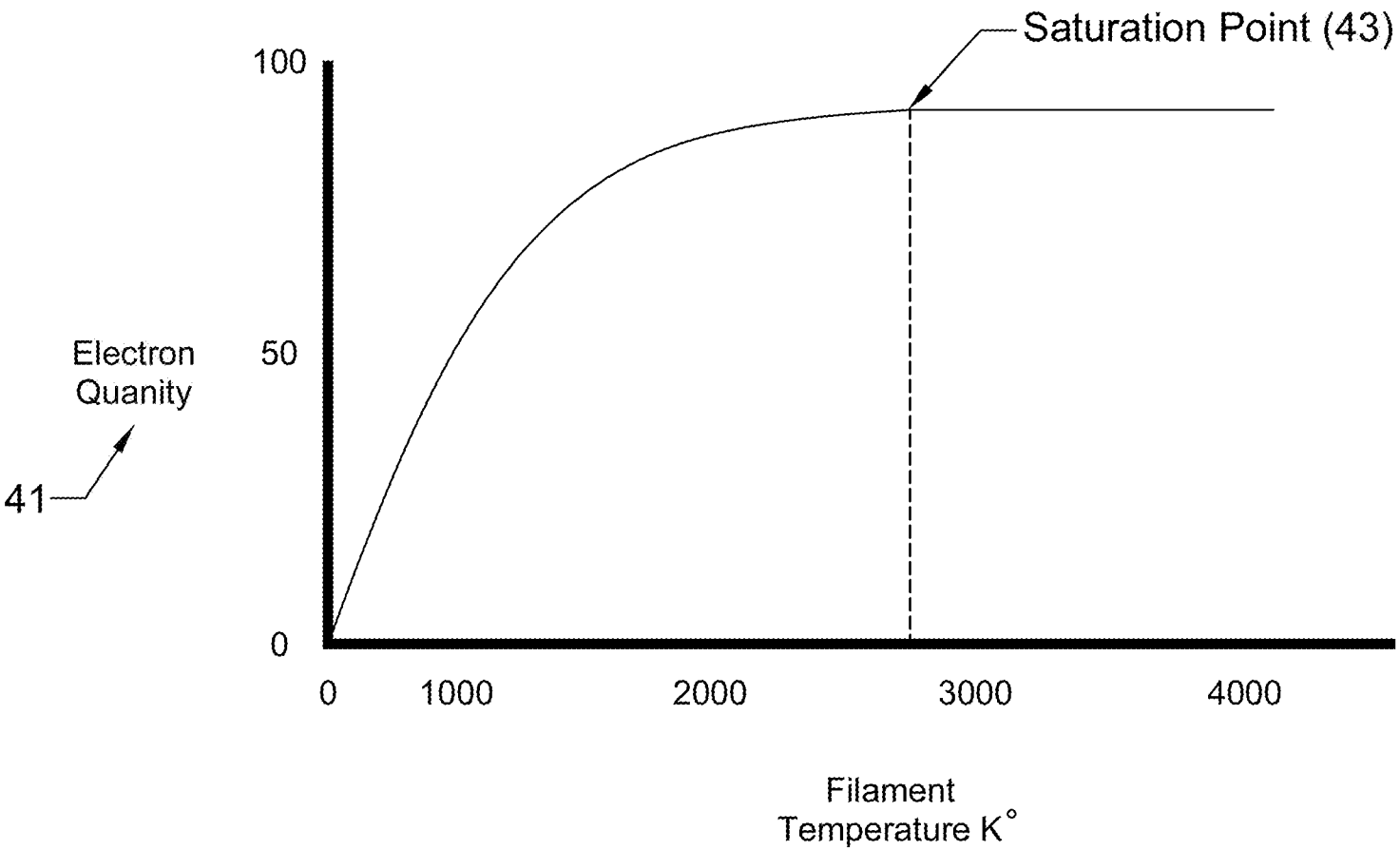
FIG. 4 is a graphical representation of the electron quantity verses filament temperature of an exemplary filament.

Referring now to FIG. 4 there is illustrated a graphical representation of electron quantity 41 verses filament temperature 42 in Kelvin of single filament 7 of cylindrical anode X-ray tube 100. Relative electron quantity 41 is a consequence of filament temperature 42 in Kelvin of single filament 7. All filament types have unique characteristics. These characteristic are cold/hot resistance, work function and saturation temperature. The cold/hot resistance is important because it determines the parameters of adjustable filament power supply 33 but does not affect the space charge region shown as trajectory 36 of electrons 35 of single filament 7. The work function of a filament is a measure of how easy or difficult it is to extract electrons from of single filament 7. The work function of a filament, such as of single filament 7, is a consequence of its chemical formulation and its shape and parameters can have a dramatic effect on the space charge region shown as trajectory 36 of electrons 35 of single filament 7 at lower temperatures. The filament saturation temperature is the point, saturation point 43 at which additional heat will not cause an increase in the number of electrons 35 accelerated from single filament 7. In FIG. 4 saturation point 43 occurs approximately at 3000 Kelvin for the representative single filament 7. By careful manipulation of the characteristic of single filament 7 the Gaussian like shape of relative output radiation DOSE 21 of the space charge region shown as trajectory 36 of electrons 35 of single filament 7 can be mitigated to some degree but the resulting radiation pattern will always be asymmetrical and limited in length 22, for example, from four (4) to six (6) on length 22 of single filament 7 as shown in FIG. 2.

Figure 5:
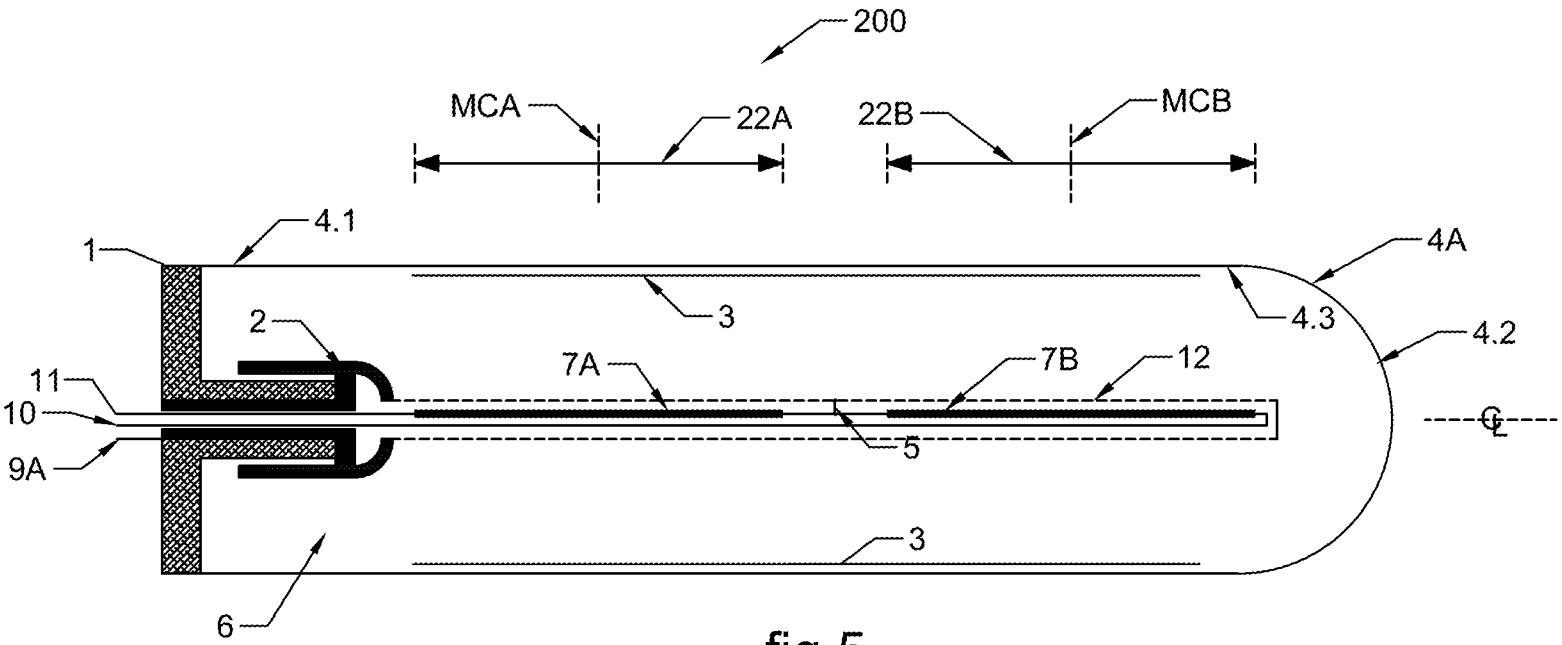
FIG. 5 is a cross sectional side view of a longitudinal high dose output, through transmission target X-ray tube with two or more filaments.
Figure 5A:
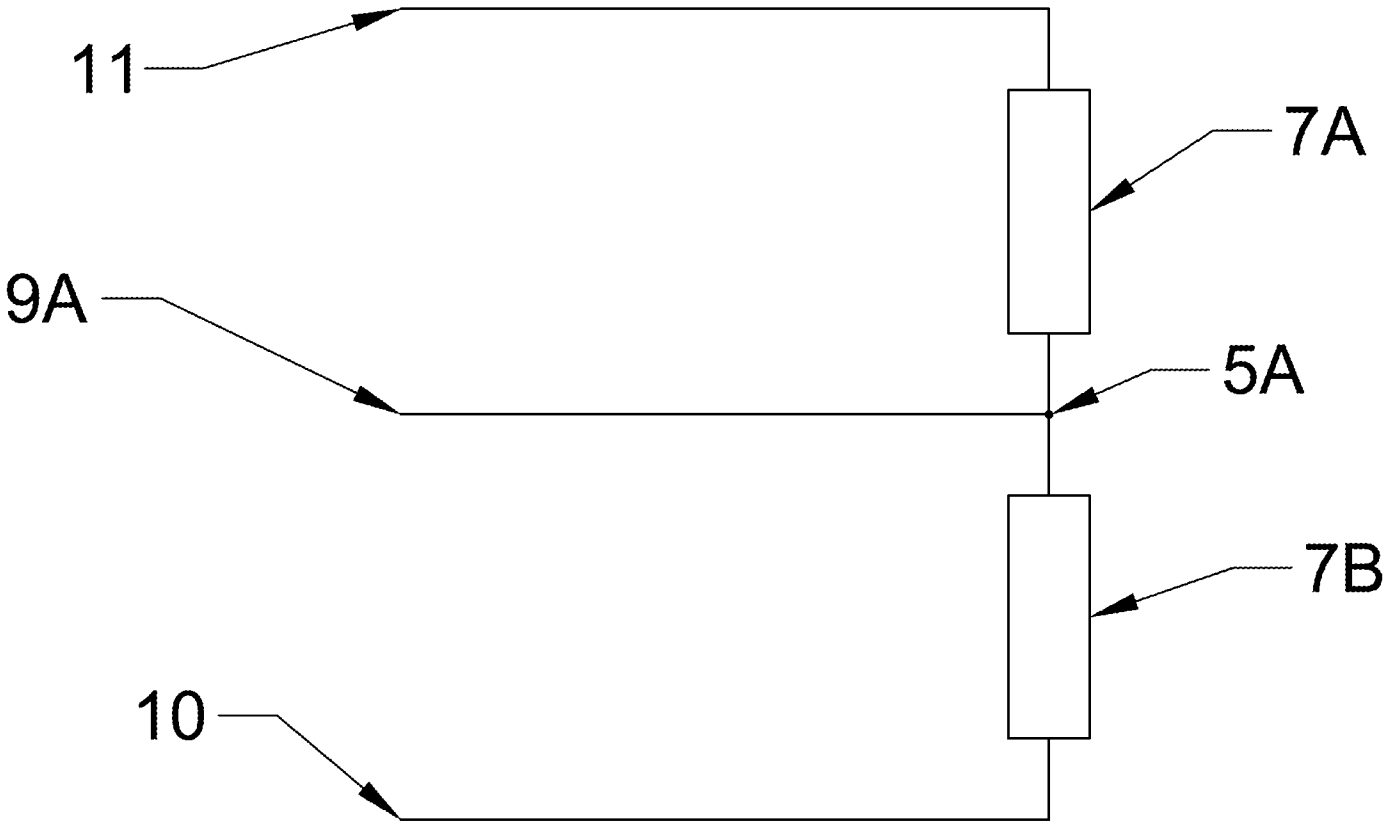
FIG. 5A is a schematic representation of the two or more filaments longitudinal X-ray tube of FIG. 5 showing the two or more filaments mounted mechanically in series.

Referring now to FIGS. 5 and 5A there is illustrated a cross sectional side view of an X-ray tube 200 which includes evacuated sealed elongated chamber or envelope, such as elongated housing 4A, which may be glass, alloy, metal or the like, high voltage insulator 1 positioned on one end or first end 4.1 of elongated housing 4A, vacuum dielectric 6, approximately $1\times10^{-10}$ mBar, contained therein elongated housing 4A.

Contained within anode structure, elongated housing 4A are elements, such as, cathode structure 2, three or more filament leads, such as first filament lead 11, second filament lead 10, common filament lead or third filament lead 9A, and two or more filaments 7A-7N. It is contemplated herein that two or more filaments 7A-7N may be positioned mechanically in series, electrically in series, end-to-end, partially overlapping, and/or proximate center line CL of elongated housing 4A and combinations thereof. Cathode structure 2 may be connected to ground, cathode electrical connection, or common or third filament lead 9A of adjustable high voltage power supply shown in FIG. 6. One end or first filament end of first filament 7A is electrically connected to first filament lead 11 and first filament lead 11 may also be electrically connected to first adjustable filament power supply 64 shown in FIG. 6 and the other end or second filament end of first filament 7A may be electrical connected to common electrical connection 5A or third filament lead 9A and third filament lead 9A may also be electrically connected to first adjustable filament power supply 64 shown in FIG. 6. One end or first filament end of second filament 7B is electrically connected to second filament lead 10 and second filament lead 10 may also be electrically connected to second adjustable filament power supply 65 shown in FIG. 6 and the other end or second filament end of second filament 7B may be electrical connected to common electrical connection 5A or third filament lead 9A and third filament lead 9A may also be electrically connected to second adjustable filament power supply 65 shown in FIG. 6.

It is contemplated herein that first filament lead 11 and second filament lead 10 may be electrically connected to adjustable filament power supply 64/65.

It is contemplated herein that three, four or more filaments may be utilized for filaments 7A-7N in an effort to lengthen the output radiation pattern of X-ray tube 200. Furthermore, elongated housing 4A may be configured as cylindrical, tubular or any length extending configuration to form evacuated sealed elongated chamber or envelope. Moreover, one or more adjustable filament power supply 64/65 may be utilized to power filaments 7A-7N.

Moreover, elongated housing 4A includes target, target element, or target material, such as anode target or through transmission anode 3 deposited, formed or configured thereon elongated housing 4A as anode structure, where target material, such as through transmission anode 3 is preferably deposited thereon elongated anode target surface area, such as inner surface 4.3 of elongated housing 4A to dissipate heat. Preferably through transmission anode 3 being the electron interacting material deposited thereon inner surface 4.3 of elongated housing 4A and together comprise anode structure. Preferably anode target or through transmission anode 3 may be electro-chemically platted, mechanically bonded, or vapor deposited using evaporation or sputtering technique thereon inner surface 4.3 of elongated housing 4A.

Figure 7:
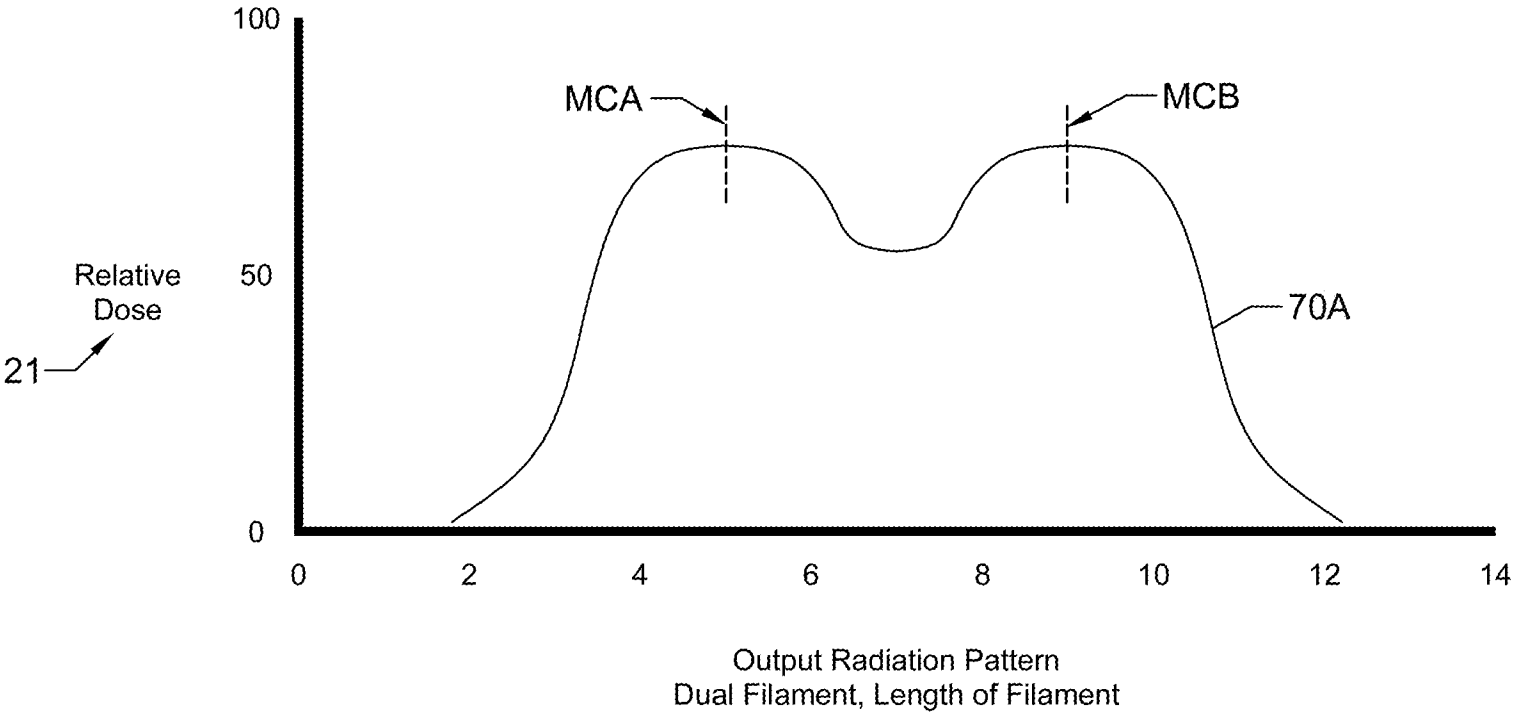
FIG. 7 is a graphical representation of the two or more filaments of longitudinal X-ray tube of FIG. 5 showing relative DOSE verses two or more filaments length.

Moreover, inner surface 4.3 of elongated housing 4A may be coated with various elements, combination of elements or their alloys as through transmission anode 3 to form anode structure and produce desirable characteristic elongated or lengthened x-ray field, such as radiation 70A shown in FIG. 7. High Z elements may be selected to produce increased output with multiple Gaussian like output overlapping radiation patterns.

It is further recognized herein that target, anode structure, or through transmission anode 3 configured with a large surface area to receive an equalized distribution of electrons from filaments 7A and 7B symmetrically across through transmission anode 3 and thus, generates elongated or lengthened x-ray field, such as radiation 70A shown in FIG. 7.

It is still further recognized herein that through transmission anode 3 is preferably formed of at least one suitable material (target element), such as gold (Au) or Lead (Pb), including other elements with atomic number between 73 through 82, and additionally copper (Cu), silver (Ag), and Uranium (U) may be utilized for through transmission anode 3. Preferably, these materials include other suitable characteristics, such as high $K_\alpha$ energy level, high conversion rate of electrons to X-ray or other beneficial characteristic understood by one skilled in the art.

It is still further recognized herein that the elongated housing 4A is preferably formed of a material that is substantially X-ray transparent, such as Beryllium, Carbon, Aluminum, Ceramic, Stainless Steel, alloys of said material and combinations thereof.

Referring now to FIG. 5A there is illustrated a schematic of X-ray tube 200 having two or more filaments 7 positioned therein longitudinal X-ray tube showing the two or more filaments mounted mechanically in series or end-to-end or proximate center line CL. It is contemplated herein that three, four or more filaments may be utilized for filaments 7A-7N and further positioned mechanically in series with filaments 7A and 7B in an effort to further lengthen the output radiation pattern of X-ray tube 200.

Figure 6:
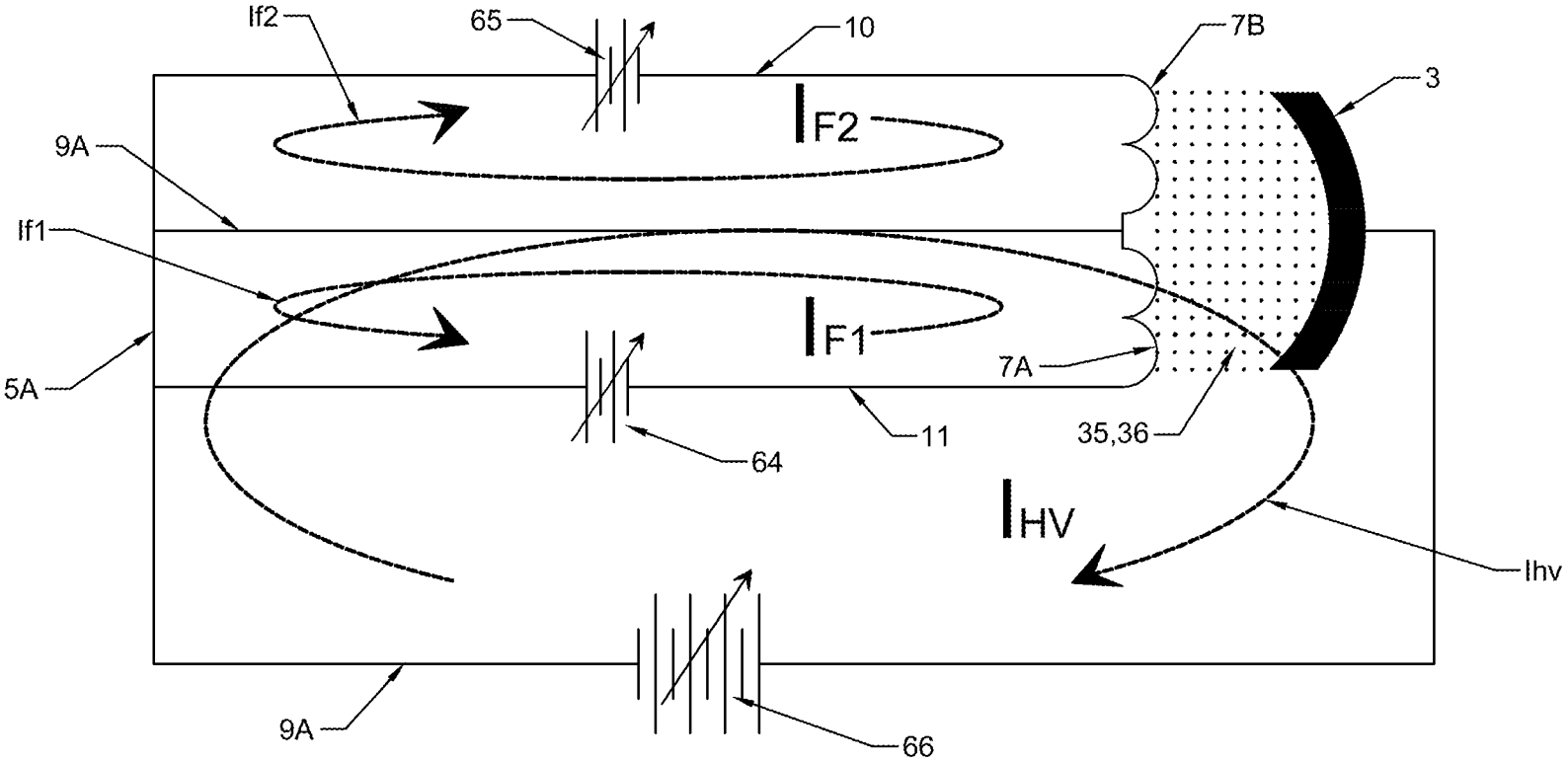
FIG. 6 is a schematic representation of the two or more filaments of longitudinal X-ray tube of FIG. 5 showing a profile of the linear extended (broadened) electron trajectory lines which are being emitted from the two or more filaments.

Referring now to FIG. 6 there is illustrated a schematic representation of the two filaments, X-ray tube 200 showing a profile of the electron trajectory lines which are being emitted from first filament 7A and second filament 7B. One end or first filament end of first filament 7A is electrically connected to first filament lead 11 and first filament lead 11 may also be electrically connected to first adjustable filament power supply 64 and the other end or second filament end of first filament 7A may be electrical connected to common electrical connection 5A or third filament lead 9A and third filament lead 9A may also be electrically connected to first adjustable filament power supply 64. One end or first filament end of second filament 7B is electrically connected to second filament lead 10 and second filament lead 10 may also be electrically connected to second adjustable filament power supply 65 and the other end or second filament end of second filament 7B may be electrical connected to common electrical connection 5A or third filament lead 9A and third filament lead 9A may also be electrically connected to second adjustable filament power supply 65.

In an X-ray system, first adjustable filament power supply 64 and second adjustable filament power supply 65 may be independent power supplies or common power supply referenced to cathode potential, common electrical connection 5A, or third filament lead 9A and provides current $I_{F1}$ and $I_{F2}$ necessary to heat first filament 7A and second filament 7B, and thus, create symmetrical electron distribution or space charge region shown as trajectory 36 of plurality of accelerated electrons, such as electrons 35 along length 22A of first filament 7A and length 22B of second filament 7B. It is recognized herein that two or more filaments 7A-7N enables symmetrical electron distribution of trajectory 36 of electrons 35 on lengthened or increased or elongated anode target surface area, such as of through transmission anode 3. The difference in potential between cathode structure 2 and cylindrical through transmission anode 3 caused by adjustable high voltage power supply 66 extracts electrons from the space charge region shown as trajectory 36 of electrons 35 along length 22A of first filament 7A and length 22B of second filament 7B and accelerates electrons towards through transmission anode 3. Moreover, plurality of accelerated electrons 35 originating from said two or more filaments, such as first filament 7A and second filament 7B. The number of electrons that are accelerated constitutes high voltage current $I_{HV}$ and is determined by the temperature of first filament 7A and length 22B of second filament 7B and the high voltage potential of adjustable high voltage power supply 66.

Moreover, each of first adjustable filament power supply 64 and second adjustable filament power supply 65 may be electronically controlled to heat each filaments 7A-7N, such as first filament 7A and second filament 7B, sufficiently to produce approximately half or its portion of the desired high voltage current $I_{HV}$.

Referring now to FIG. 7 there is illustrated a graphical representation of relative output radiation DOSE 21 verses length 22 of first filament 7A and second filament 7B of X-ray tube 200. Relative output radiation DOSE 21 is a consequence of the shape of the electron space charge region along length 22A and 22B of first filament 7A and second filament 7B. All filaments in X-ray tubes or light bulbs tend to heat from the center outwards. This phenomena causes Gaussian like space charge regions shaped along length 22A and 22B of first filament 7A and second filament 7B each coincident with a center line or mechanical center MC of the filament, such as in series, end-to-end mechanical center MCA and mechanical center MCB of first filament 7A and second filament 7B and is responsible for the elongated or lengthened output radiation pattern, x-ray field, or elongated or lengthened or overlapping bremsstrahlung x-ray or x-ray field, such as radiation 70A (two similar Gaussian like output radiation patterns that overlap in the center) and thermal signature of X-ray tube 200 peaking near center line or mechanical center MCA for first filament 7A and mechanical center MCB for second filament 7B, and further causing a lengthened, widened, and/or elongated radiation output pattern, thermal signature, or x-ray field, shown in FIG. 7. Moreover, elongated or lengthened relative output radiation DOSE 21 is from two (2) to twelve (12) on length 22 of mechanically in series first filament 7A and second filament 7B, and more specifically lengthened peaking in relative output radiation DOSE 21 from four (4) to ten (10) on length 22 of first filament 7A and second filament 7B. It is recognized herein that utilizing two or more filaments, such as mechanically series first filament 7A and second filament 7B in X-ray tube 200 increases relative output radiation DOSE 21 length 22 from four (4) to ten (10) for first filament 7A and second filament 7B verses relative output radiation DOSE 21 of single filament 7, shown in FIG. 2 is from four (4) to six (6) on length 22 of single filament 7, an increase for X-ray tube 200 of three times (3×).

Figure 8B:
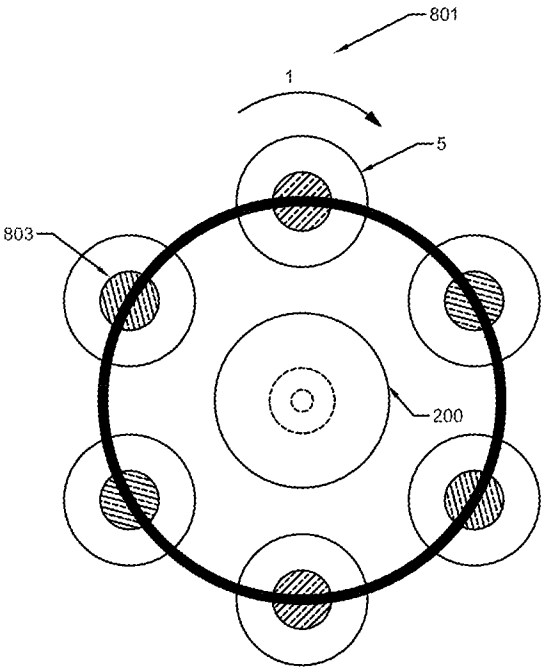
FIGS. 8A and 8B are is a side and end view of a graphical representation of X-ray tube of FIG. 5, shown in use with transport systems 800 to rotate or transport samples through lengthened output radiation pattern shown in FIG. 7.
Figure 8A:
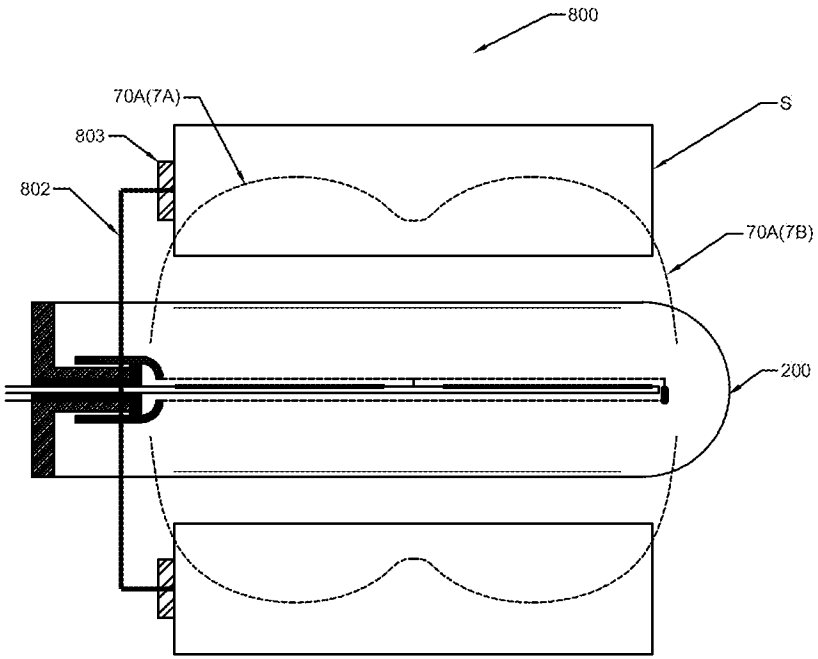

Referring now to FIGS. 8, 8A and 8B by way of example, and not limitation, there is illustrated an example application of X-ray tube 200 as mass sterilization, transport device or transport systems 800 utilizing X-ray tube 200, as shown and described in FIG. 5. In use, X-ray tube 200 characteristic and lengthened x-ray field, such as radiation 70A. Preferably, X-ray tube 200 produces radiation 70A configured to enable a wide length of intense radiation 70A to improve throughput radiation and radiate more or an increased length of items to be irradiated, such as samples S. Furthermore, samples S may be positioned proximate or adjacent X-ray tube 200 either positioned stationary or moved or transported through radiation 70A via transport systems 800, which may include a mechanical device, such as mechanical support 802 and sample attachment or bracket 803 depending on the application for an added level of even exposure of samples S subjected to radiation 70A by taking advantage of the geometrical and elongated length of the radiation 70A pattern shown in FIG. 7. Moreover, X-ray tube 200 preferably produces an elongated and symmetrical radiation field, radiation 70A, around elongated housing 4 of X-ray tube 200 to provide a consistent dose of radiation 70A to all areas of samples S in the path of radiation 70A.

It is recognized herein that transport system 800 may be a sample transportation system, rotational system, conveyor system or the like to transport or move samples S through radiation 70A of X-ray tube 200.

It is recognized herein that X-ray tube 200 radiation 70A output (i.e., dimension of length) is increased over prior art X-ray tube, shown in FIG. 1. For example, if radiation 70A output from X-ray tube 200 is lengthened by 3× as discussed above in FIG. 7 as compared to FIG. 2 then 3× the samples S may be radiated or samples S may require ⅓ the necessary runtime by X-ray tube 200 or through radiation 70A, and, thus results in a lowered operating costs and efficiency of operation of X-ray tube 200.

Figure 9:
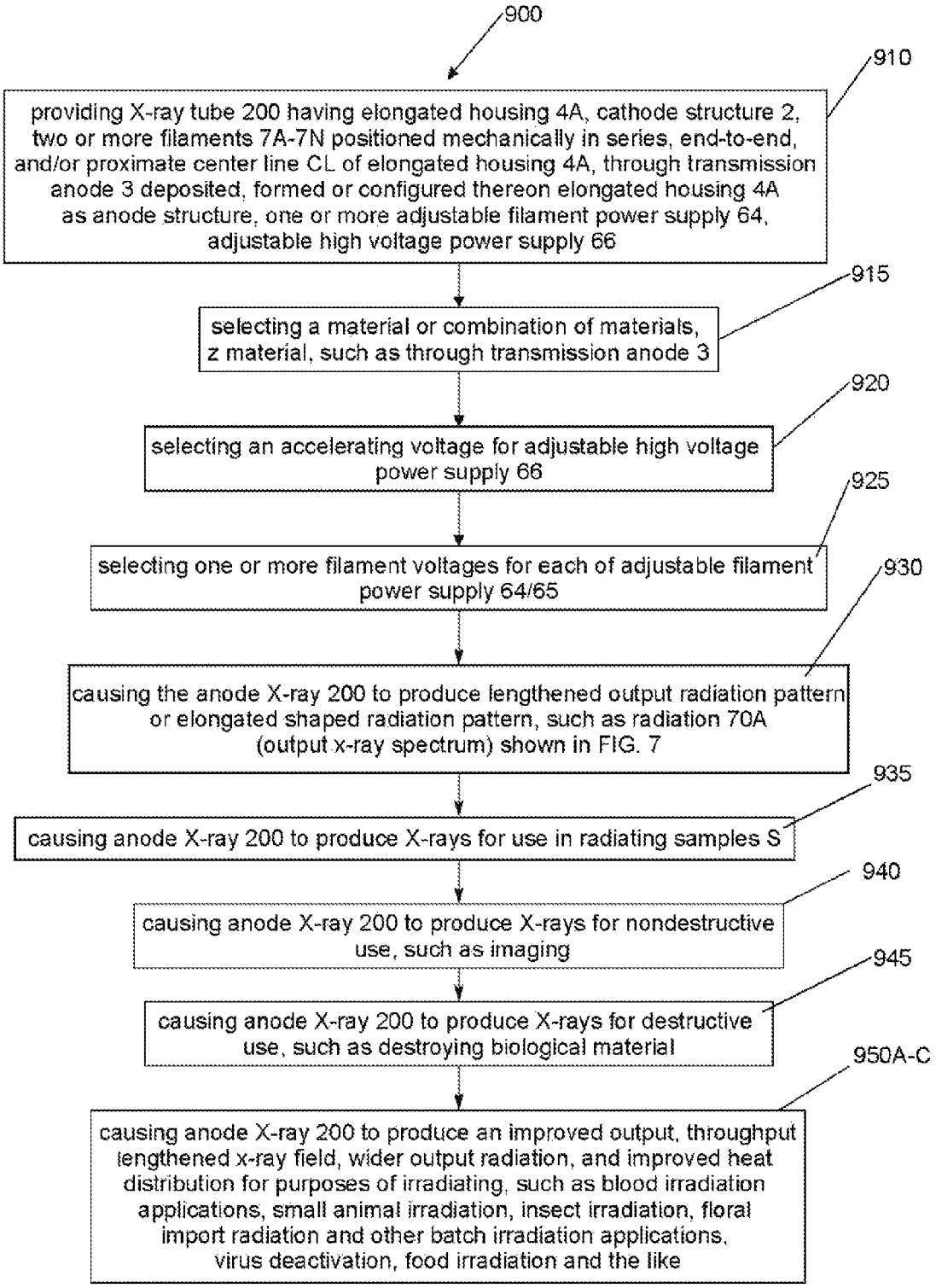
FIG. 9 is a flow diagram of a method of generating a lengthened X-ray field or lengthened output radiation pattern.

Referring now to FIG. 9, by way of example, and not limitation, there is illustrated a flow diagram 900 of a method of generating an elongated o lengthened X-ray field. In block or step 910, providing X-ray tube 200 having elongated housing 4A, cathode structure 2, two or more filaments 7A-7N positioned mechanically in series, end-to-end, and/or proximate center line CL of elongated housing 4A, through transmission anode 3 deposited, formed or configured thereon elongated housing 4A as anode structure, one or more adjustable filament power supply 64, adjustable high voltage power supply 66, as described herein. In block or step 915 selecting a material or combination of materials, z material, for target, such as through transmission anode 3. In block or step 920 selecting an accelerating voltage for adjustable high voltage power supply 66. In block or step 925 selecting one or more filament voltages for each of adjustable filament power supply 64/65. In block or step 930 causing the X-ray tube 200 to produce lengthened x-ray field, such as radiation 70A shown in FIG. 7. In block or step 935 causing X-ray tube 200 to produce X-rays for use in radiating samples S (includes steps 940, 945, 950). In block or step 940 causing X-ray tube 200 to produce X-rays (lengthened x-ray field) for nondestructive use, such as imaging. In block or step 945 causing X-ray tube 200 to produce (producing) X-rays (lengthened x-ray field) for destructive use, such as destroying biological material. In block or step 950A causing X-ray tube 200 to produce (producing) an improved output radiation pattern (lengthened x-ray field) for purposes, such as blood irradiation applications, small animal irradiation, insect irradiation and other biologicals. In block or step 950B causing X-ray tube 200 to produce (producing) a wider output radiation (lengthened x-ray field) for improved throughput for floral import radiation and other batch irradiation applications. In block or step 950C causing X-ray tube 200 to produce output radiation (lengthened x-ray field) with improved heat distribution that facilitates high dose applications for virus deactivation, food irradiation and other destructive applications.

The foregoing description and drawings comprise illustrative embodiments of the present disclosure. Having thus described exemplary embodiments, it should be noted by those ordinarily skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

What is claimed is:

1. An X-ray tube for accelerating electrons under a high voltage potential, said X-ray tube comprising:

an elongated housing that is evacuated;

a through transmission target anode structure deposited on said elongated housing, said anode structure configured having a geometric center;

a cathode structure disposed on a first end of said housing, said cathode structure configured to emit the electrons toward said anode structure;

two or more filaments disposed in said elongated housing, said two or more filaments positioned proximate said geometric center of said elongated housing and positioned mechanically in series, wherein said elongated housing is configured to vacuum seal therein said anode structure, said cathode structure, and said two or more filaments.

2. The X-ray tube of claim 1, further comprising an insulator disposed on said first end of said housing.

3. The X-ray tube of claim 1, further comprising three or more filament leads, said three or more filament leads including a first filament lead electrically connected to a first filament end of a first filament of said two or more filaments, a second filament lead electrically connected to a first filament end of a second filament of said two or more filaments, and a common filament lead electrically connected to a second filament end of said first filament and said second filament.

4. The X-ray tube of claim 3, wherein said first filament lead and said second filament lead are electrically connected to an adjustable filament power supply.

5. The X-ray tube of claim 3, wherein said first filament lead is electrically connected to a first adjustable filament power supply and said second filament lead is electrically connected to a second adjustable filament power supply.

6. The X-ray tube of claim 1, wherein said two or more filaments are configured proximately end-to-end.

7. The X-ray tube of claim 1, wherein said two or more filaments are configured partially overlapping.

8. The X-ray tube of claim 1, wherein said X-ray tube produces a lengthened X-ray field.

9. The X-ray tube of claim 1, wherein said anode structure is coated with at least one target element to produce a bremsstrahlung X-ray from a plurality of accelerated electrons originating from said two or more filaments.

10. The X-ray tube of claim 9, wherein said at least one target element is formed thereon said anode structure via electro-chemically platted, mechanically bonded, or vapor deposited using an evaporation or sputtering technique.

11. The X-ray tube of claim 9, further comprises an adjustable high voltage power supply electrically connected between said anode structure and said cathode structure.

12. The X-ray tube of claim 11, wherein said X-ray tube produces an overlapping x-ray field determined by said at least one target element, said two or more filaments, and said adjustable high voltage power supply.

13. The X-ray tube of claim 12, wherein said X-ray tube produces a lengthened x-ray field.

14. The X-ray tube of claim 13, further comprising a transport system to move a sample through said lengthened x-ray field.

15. The X-ray tube of claim 1, wherein said anode structure is formed of a material that is substantially X-ray transparent.

16. The X-ray tube of claim 15, wherein said material consists of Beryllium, Carbon, Aluminum, Ceramic, Stainless Steel, alloys of said material and combinations thereof.

17. The X-ray tube of claim 1, wherein said two or more filaments produces a symmetrical electron distribution on an increased anode target surface area of said through transmission target anode structure.

18. A method to produce a lengthened x-ray field, said method comprising the steps of:

providing an X-ray tube for accelerating electrons under a high voltage potential, said X-ray tube comprising:

an elongated housing that is evacuated, a through transmission target anode structure deposited on said elongated housing, said anode structure configured having a geometric center, a cathode structure disposed on a first end of said housing, said cathode structure configured to emit the electrons toward said anode structure, two or more filaments disposed in said elongated housing, said two or more filaments positioned proximate said geometric center of said elongated housing and positioned mechanically in series, wherein said elongated housing is configured to vacuum seal therein said anode structure, said cathode structure, and said two or more filaments;

selecting an accelerating voltage for an adjustable high voltage power supply electrically connected between said anode structure and said cathode; and selecting filament voltages for one or more adjustable filament power supply electrically connected to said two or more filaments.

19. The method of claim 18, further comprising the step of producing a lengthened output radiation pattern.

20. The method of claim 19, further comprising the step of producing a lengthened x-ray field for radiating samples.

21. The method of claim 20, wherein said samples further comprises a biological material.

22. The method of claim 20, wherein said samples further comprises a batch irradiation application.

23. The method of claim 20, wherein said samples further comprises a destructive irradiation application.

* * * * *